US005218791A

United States Patent [19]

Parent et al.

[11] Patent Number: 5,218,791

[45] Date of Patent: Jun. 15, 1993

[54] METHOD OF CLEANING FOAMED ARTICLES

[75] Inventors: Wilfred Parent, Milton, N.H.; Laurent R. Gaudreau, South Berwick, Me.

[73] Assignee: Davidson Textron Inc., Dover, N.H.

[21] Appl. No.: 851,427

[22] Filed: Mar. 13, 1992

[51] Int. Cl.[5] ..... B24C 1/10

[52] U.S. Cl. ..... 51/319; 51/410; 51/428

[58] Field of Search ..... 51/319, 320, 321, 410, 51/428, 427

[56] References Cited

U.S. PATENT DOCUMENTS

| | | | |
|---|---|---|---|
| 3,090,166 | 5/1963 | Straub | 51/9 |
| 3,396,495 | 8/1968 | Voss | 51/320 |
| 3,628,295 | 12/1971 | Curtiss | 54/319 |
| 3,696,565 | 10/1972 | Claeys | 51/320 |
| 3,767,096 | 10/1973 | Coscia | 225/97 |
| 3,909,988 | 10/1975 | Kerwin et al. | 51/163 |
| 4,128,197 | 12/1978 | Ischenko et al. | 225/97 |
| 4,242,299 | 12/1980 | Adams | 264/504 |
| 4,312,156 | 1/1982 | McWhorter | 51/418 |
| 4,519,812 | 5/1985 | Brull et al. | 51/422 |
| 4,548,617 | 10/1985 | Miyatani et al. | 51/298 |
| 4,549,066 | 10/1985 | Piccioli et al. | 219/121 LG |
| 4,688,309 | 8/1987 | Cordova et al. | 29/90 R |
| 4,696,421 | 9/1987 | Durr | 225/1 |

*Primary Examiner*—Bruce M. Kisliuk
*Assistant Examiner*—Eileen P. Morgan
*Attorney, Agent, or Firm*—Reising, Ethington, Barnard, Perry & Milton

[57] ABSTRACT

Molded urethane articles (10) are deflashed by impinging or shooting particles (14) of polyvinyl chloride at the flash (18) which develops between the seams of the mold parts. The polyvinyl chloride particles (14) are random in shape and have a maximum cross-sectional measure of 0.125 inches. The polyvinyl chloride particles (14) are set in motion using a blast of air produced by a particle blaster (12). The polyvinyl chloride particles (14) have a hardness range (50–85 Shore A durometer) which is hard enough to deflash articles made of semi-rigid urethane and, yet, soft enough not to damage a polyvinyl chloride cone.

3 Claims, 2 Drawing Sheets

METHOD OF CLEANING FOAMED ARTICLES

METHOD OF CLEANING FOAMED ARTICLES BACKGROUND OF THE INVENTION (1) Field of the Invention This invention relates to automated methods of deflashing articles. More particularly, the invention relates to automated methods of deflashing molded urethane articles using a blast of particles.

(2) Description of Related Art

Molded articles made from two or more mold pieces collect excess material, called flash, along the seams where the mold pieces meet. The flash is undesirable because it hinders proper alignment of the parts and it is not aesthetically pleasing.

Currently, there are two types of methods for removing the flash, or, in other words, deflashing molded articles. The first method is the manual removal of the flash. This method is undesirable because it slows production and it is labor intensive; both of which render this method cost inefficient.

The second method of deflashing a molded article is an automated procedure. This is typically done by projecting an object or objects at the flash of an article with sufficient inertia to deflash the molded article. U.S. Pat. Nos. 3,628,295 and 3,696,565 to Curtiss and Claeys, respectively, both disclose methods for deflashing articles by projecting small particles, glass beads and rubber particles, respectively, at the article having the flash.

The usage of glass beads is not acceptable in instances where the finish of the molded article would be damaged due to the hardness of the glass beads. On the other hand, the rubber particles are not acceptable due to the elasticity of rubber when impinged upon molded articles which are semi-rigid. Also, rubber particles tend to gel when they heat up resulting in particles that are difficult to project and/or reuse.

U.S. Pat. No. 3,396,495 to Voss, issued Aug. 13, 1968 discloses a method for deflashing black phenolic plastic which is a hard plastic. The flash created when molding with black phenolic plastic is removed by projecting acrylic plastic at the black phenolic plastic article. More specifically, Lucite Plastic Compound #29 or #47, as marketed by the DuPont Company, Inc., is the acrylic plastic used. The acrylic plastic, however, is very hard and will damage articles of softer material.

U.S. Pat. No. 3,090,166 to Straub, issued May 21, 1963 discloses a polishing method and device for polishing hard surfaces. The method includes the steps of projecting soft particles at hard surfaces, such as metal. The method, however, is incapable of deflashing any of the articles because the articles are made of materials which are unaffected by the soft particles.

A method of automatically deflashing molded articles is needed wherein particles are rigid enough to deflash semi-rigid articles properly and, yet, soft enough so as not to harm the molded article.

SUMMARY OF THE INVENTION AND ADVANTAGES

A method for deflashing the flash of molded urethane articles is disclosed. A particle blaster is used wherein the steps include supporting the molded urethane article and impinging it with the particles of polyvinyl chloride.

Many automotive parts are made of urethane, and, more particularly, semi-rigid urethane wherein the semi-rigid urethane is covered with a polyvinyl chloride shell or covering. Semi-rigid urethane articles are best deflashed by polyvinyl chloride particles because the polyvinyl chloride particles are hard enough to effectively deflash the semi-rigid urethane article without harming the surface of the semi-rigid urethane articles or the polyvinyl chloride covering.

FIGURES IN THE DRAWINGS

Other advantages of the present invention will be readily appreciated as the same becomes better understood by reference to the following detailed description when considered in connection with the accompanying drawings wherein:

FIG. 1 is a perspective view of the preferred embodiment of the subject invention; and FIG. 2 is a cross section of a mold assembly.

DETAILED DESCRIPTION OF A PREFERRED EMBODIMENT OF THE INVENTION

Figure 1:
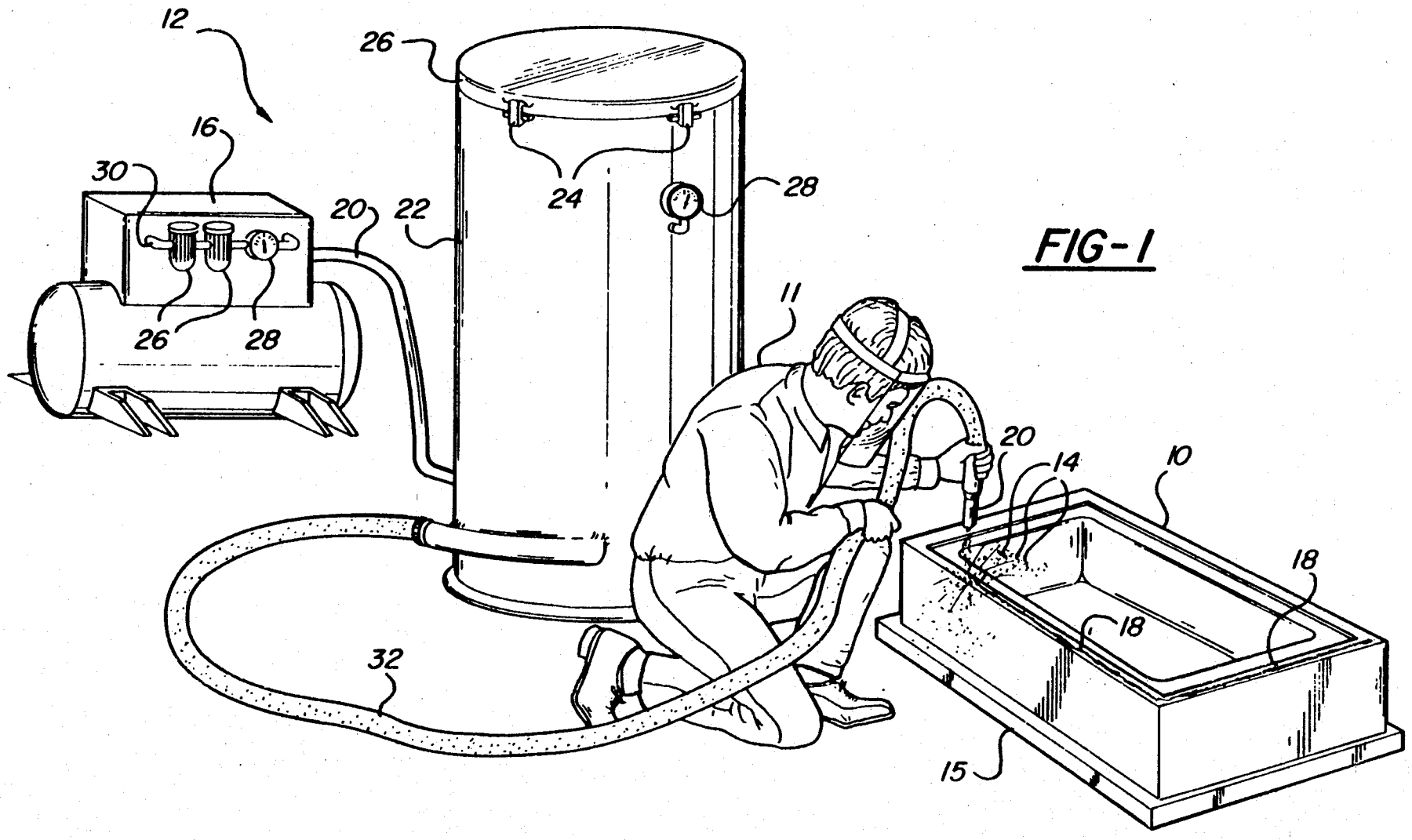

A method for deflashing the flash on molded urethane articles 10 is generally shown in FIG. 1. A particle blaster, generally shown at 12, is aimed at a molded urethane article 10 by an operator 11 and impinges or shoots particles 14 at the molded urethane article 10. The molded urethane article 10 is supported in place by the support structure 15. The support structure 15 helps the deflashing process by effectively aligning the molded urethane article 10 where flash 18 on the urethane article 10 will most likely be present. The method is characterized by impinging particles 14 of polyvinyl chloride at the molded urethane article 10. In FIG. 1, the molded urethane article 10 is shown to be supported so the flash 18 is visible and easily accessible to the operator 11.

The particle blaster 12 will project the impinging polyvinyl chloride particles 14 with the use of blasts of forced air. The particle blaster 12 may use compressed air or any other suitable means to force air through a nozzle 20 at such a velocity as to carry polyvinyl chloride particles 14 at a force to effectively deflash the molded urethane article 10. In the subject method, an air compressor 16 forces air through the hose 20 into a pressurized storage tank 22. The forced air is mixed with the polyvinyl chloride particles 14 stored in the pressurized storage tank 22, which is filled through the latched 24 lid 26. A gauge 28 measures air pressure in the pressurized storage tank 22. The mixture of forced air and polyvinyl chloride particles 14 is forced through a hose 32 and is emitted through a nozzle 20. The nozzle 20 can vary in diameter depending on the particular task at hand. The blasts of air may be sporadic, or they may be continuous. The size of the molded urethane article 10 and the amount of flash 18 to be deflashed will determine the proper flow rate of the air and polyvinyl chloride particles 14. The air compressor 16 comprises a pump (not shown) which pumps air under pressure of from 40 to 120 PSI and at a flow rate of from 2 to 15 CFM through two filters 26 and a gauge 28 via the tubing 30.

Figure 2:
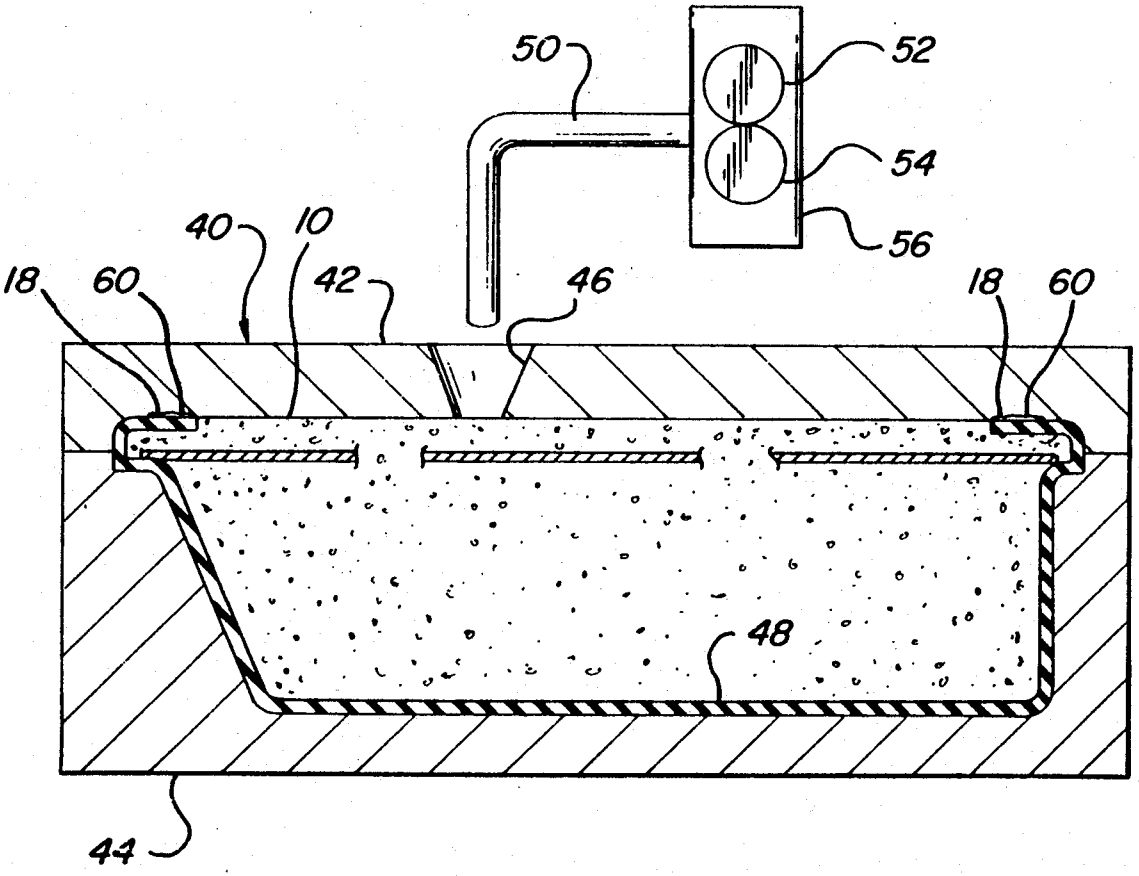

A better understanding of how flash 18 is produced may be seen by turning to FIG. 2 wherein a standard two piece mold is generally indicated at 40. The two piece mold has an upper portion 42 and a lower portion 44. The upper portion 42 includes a funnel 46 for receiving the materials necessary to produce the urethane article 10 A shell or skin 48, typically polyvinyl chloride, covers the interior of the lower portion 44 of the mold 40 and a portion of the upper portion 42 and is produced prior to the fabrication process of the urethane article 10. A rigid support 49, shown partially cut away in FIG. 2, is used to provide support to body of the molded urethane article 10. Also the rigid support 49 is used to receive fasteners, such as screws (not shown) so it may be properly secured. The urethane used to produce the article 10 is sent through the tubing 50. Two tubes 52, 54 are schematically shown to represent the two tubes 52, 54 that lead in the tubing 50 and are held by a support 56. Each of the two tubes 52, 54 carries one or more compounds which react together to form the final product. As an example, two of compounds which may be used are an organic polyisocyanate and a polyol stream.

The flash 18 occurs at the location 60 where the urethane, when curing, seeps out from the edges of the polyvinyl chloride cover 48 located at the upper portion 42 of the mold assembly 40. When the upper portion 42 is removed, the urethane that has seeped beyond the polyvinyl chloride cover 48, called flash 18, creates functional problems with respect to abutting pieces of equipment, if any, as well as aesthetically due to the non-uniformities in the amounts of flash 18 which exist.

The polyvinyl chloride particles 14 that are used in this method have no particular shape. In fact, random shapes are preferred in the subject method so as to provide a more uniform and efficient deflashing of the molded urethane articles 10. In other words, random shapes help insure all portions of the flash 18 will be hit by the polyvinyl chloride particles 14. Not only do the polyvinyl chloride particles 14 not have to be any particular shape but they may also be of unequal size. These polyvinyl chloride particles 14 are typically produced from ground up scrap shells, thus increasing cost efficiency. This also lends to the cost efficiency of the method because there are few special provisions needed for such particles 14.

Although the polyvinyl chloride particles 14 are of unequal size, the maximum cross-sectional measure of the polyvinyl chloride particles 14 should not exceed 0.125 inches. In the preferred embodiment, such a size restriction maximizes the polyvinyl chloride particle's 14 speed as well as maximizing the amount of flash 18 that is deflashed. In other words, a size restriction of 0.125 inches increases the uniform deflashing capability of the polyvinyl chloride particles 14 without imparting a damaging force to the molded urethane particles 10.

To further define the polyvinyl chloride particles 14, the polyvinyl chloride particles 14 should have a hardness within the range from 50 to 85 Shore A durometer. Again, this hardness maximizes the ability of the final particles 14 to deflash the flash 18 of the molded urethane articles 10 without damaging the surface of the molded urethane articles 10. The composition of the particles 14 is not limited to polyvinyl chloride but is limited to the hardness range. More specifically, the hardness of the particles used is very important because if the particles are too hard, they will damage the semi-rigid urethane article and if they are too soft they will not effectively deflash the semi-rigid urethane article.

For the best results of the preferred embodiment, the molded urethane article 10 preferably is a thermoset polyether based urethane in which the macroglycol is a polyether that is combined with a known low molecular weight chain extender and a diisocyanate such as MDI and has a density of between four and ten pounds per cubic foot. Other thermoset urethanes including macroglycol such as polyesters or polycaprolactone can be combined with the low molecular weight chain extender and diisocyanate. The urethane used to produce these molded urethane articles 10 is commonly referred to as semi-rigid urethane having a hardness in the range of 50–60 Shore A durometer.

Typically, these semi-rigid urethane articles 10 are covered or enclosed in a vinyl shell 48 wherein the vinyl shell 48 has a specific gravity in the range of 1.0–1.4. Although polyvinyl chloride (PVC) is the preferred abradant, the family of vinyls comprises a number of resins based on the vinyl monomer unit or vinylidene monomer unit including polyvinyls and vinyl copolymers.

Such semi-rigid urethanes/vinyl shell combinations are typical material selections for automotive interior trim products.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method for deflashing molded urethane that is partially covered by a polyvinyl chloride cover having an edge portion at which the molded urethane forms urethane flashing around the edge portion of the polyvinyl chloride cover comprising the steps of:

providing a molded urethane having a Shore A hardness in the range of 50–60 durometer;

providing randomly shaped dry resin particles from the group comprising either a resin having a vinyl monomer unit or a resin having a vinylidene monomer unit and wherein each particle has a Shore A hardness of between 50–85 durometer and wherein each particle further has a maximum cross-sectional measurement less than 0.125 inches;

directing only the dry resin particles into an air blast stream at a pressure between 40 to 120 psi and at a flow rate of between 2 to 15 CFM and directing the air blast stream with the dry resin particles therein against the uretahne flashing around the edge portion of the polyvinyl chloride cover for selectively separating the urethane flashing from the edge portion of the polyvinyl chloride cover without damaging the polyvinyl chloride cover.

2. The method for deflashing molded urethane setforth in claim 1 further comprising providing a urethane having a density of between 4 to 10 pounds per cubic foot.

3. The method for deflashing molded urethane setforth in claim 1, further comprising providing a polyvinyl chloride cover having a specific gravity in the range of 1.0 to 1.4.

* * * * *